US008487220B2

(12) United States Patent
Serrago et al.

(10) Patent No.: US 8,487,220 B2
(45) Date of Patent: Jul. 16, 2013

(54) VACUUM OVEN

(76) Inventors: Daniel F. Serrago, Plano, TX (US); James D. Emmons, Plano, TX (US)

( * ) Notice: Subject to any disclaimer, the term of this patent is extended or adjusted under 35 U.S.C. 154(b) by 366 days.

(21) Appl. No.: 12/949,145

(22) Filed: Nov. 18, 2010

(65) Prior Publication Data

US 2011/0114626 A1 May 19, 2011

Related U.S. Application Data

(60) Provisional application No. 61/262,318, filed on Nov. 18, 2009.

(51) Int. Cl.

| | |
|---|---|
| ***A61C 13/20*** | (2006.01) |
| ***F27B 1/12*** | (2006.01) |
| ***F27B 1/22*** | (2006.01) |
| ***F27D 1/10*** | (2006.01) |

(52) U.S. Cl.

USPC ..... 219/390; 219/399; 219/407; 219/530; 432/241; 432/249; 373/111; 373/112; 373/119; 373/137

(58) Field of Classification Search

None

See application file for complete search history.

(56) References Cited

U.S. PATENT DOCUMENTS

| | | | | |
|---|---|---|---|---|
| 590,214 | A | 9/1897 | Dail | |
| 714,373 | A | 11/1902 | Hewett et al. | |
| 787,584 | A | 4/1905 | Matteson | |
| D69,806 | S | 5/1924 | Phare et al. | |
| 1,534,592 | A * | 4/1925 | Houck | 219/390 |
| D115,132 | S | 6/1939 | Schneider | |
| 2,210,483 | A | 8/1940 | Feron | |
| 3,441,652 | A | 4/1969 | Eicker | |
| 4,272,670 | A * | 6/1981 | Docx | 219/390 |
| 4,332,553 | A * | 6/1982 | Earle et al. | 432/205 |
| 4,671,770 | A * | 6/1987 | Bell et al. | 433/223 |
| 4,828,490 | A | 5/1989 | Indig | |
| 4,912,302 | A * | 3/1990 | Kobayashi et al. | 219/390 |
| 5,062,372 | A * | 11/1991 | Ritter | 110/242 |
| 5,207,573 | A * | 5/1993 | Miyagi et al. | 432/182 |
| 5,266,777 | A | 11/1993 | Oppawsky et al. | |
| 5,313,048 | A * | 5/1994 | Berg et al. | 219/390 |
| 6,252,202 | B1 * | 6/2001 | Zychek | 219/390 |
| 6,369,361 | B2 * | 4/2002 | Saito et al. | 219/390 |
| 6,384,382 | B2 * | 5/2002 | Rohner et al. | 219/413 |
| 7,001,178 | B2 * | 2/2006 | Grunenfelder et al. | 432/206 |
| 7,479,619 | B2 * | 1/2009 | Saito et al. | 219/390 |
| 8,232,506 | B2 * | 7/2012 | Jussel | 219/390 |
| 2007/0082307 | A1 * | 4/2007 | Zubler | 431/120 |
| 2008/0237211 | A1 * | 10/2008 | Jussel | 219/390 |
| 2009/0226855 | A1 * | 9/2009 | Rohner et al. | 432/4 |
| 2010/0047731 | A1 * | 2/2010 | Zubler | 432/45 |

* cited by examiner

*Primary Examiner* — Joseph M Pelham

(74) *Attorney, Agent, or Firm* — Scott T. Griggs; Griggs Bergen LLP

(57) ABSTRACT

A vacuum oven or vacuum furnace is disclosed having a heat distribution sleeve that conforms to the shape of an interior heating chamber. The heat distribution sleeve may be of generally annular shape, like a ring, and located in a substantially regularly spaced and offset relationship from a heating element located within walls adjacent the interior heating chamber. The heat distribution sleeve includes a thermal conductive material which absorbs and re-radiates heat emitted from the heating element, thereby providing more consistent and regular radiation fields for heating treating a work piece that is loaded on a work holding tray and, upon the vacuum oven being in an operational position, the work piece is located within the furnace chamber.

14 Claims, 7 Drawing Sheets

VACUUM OVEN

PRIORITY STATEMENT & CROSS-REFERENCE TO RELATED APPLICATIONS

This application claims priority from U.S. patent application Ser. No. 61/262,318, entitled "Vacuum Oven" and filed on Nov. 18, 2009, in the names of Daniel F. Serrago and James D. Emmons; which is hereby incorporated by reference for all purposes.

TECHNICAL FIELD OF THE INVENTION

This invention relates, in general, to temperature distribution and regulation and, in particular, to a vacuum oven adapted for heat treating a work piece positioned therein.

BACKGROUND OF THE INVENTION

One of the problems that has arisen in connection with vacuum ovens or furnaces is that of heat distribution in the oven. That is, all of the work area doesn't see a similar radiation field. Inconsistent and irregular radiation fields can result in hard spots or residual stress in metals, different surface finishes and color variations in ceramics and porcelains, and a myriad of other issues in more exotic materials. These inconsistent and irregular radiation fields necessitate new vacuum ovens that have more uniform radiation fields.

SUMMARY OF THE INVENTION

It would be advantageous to achieve a vacuum oven adapted for heat treating a work piece. It would also be desirable to enable consistent and regular radiation fields when applying heat treatment to a work piece. To better address one or more of these concerns, in one embodiment, a bottom loading vacuum oven or vacuum furnace is disclosed having a heat distribution sleeve that conforms to the shape of an interior heating chamber. The heat distribution sleeve may be of generally annular shape, like a ring, and located in a substantially regularly spaced and offset relationship from a heating element located within walls adjacent the interior heating chamber. The heat distribution sleeve includes a thermal conductive material which absorbs and re-radiates heat emitted from the heating element, thereby providing more consistent and regular radiation fields for heating treating a work piece that is loaded on a work holding tray and, upon the bottom loading vacuum oven being in an operation position, the work piece is located proximate to the furnace chamber. The teachings disclosed herein while relating to vacuum furnaces are particularly applicable to small vacuum furnaces of the type used in the dental industry for firing crowns, implants and any type of porcelain fixture. These and other aspects of the invention will be apparent from and elucidated with reference to the embodiment(s) described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
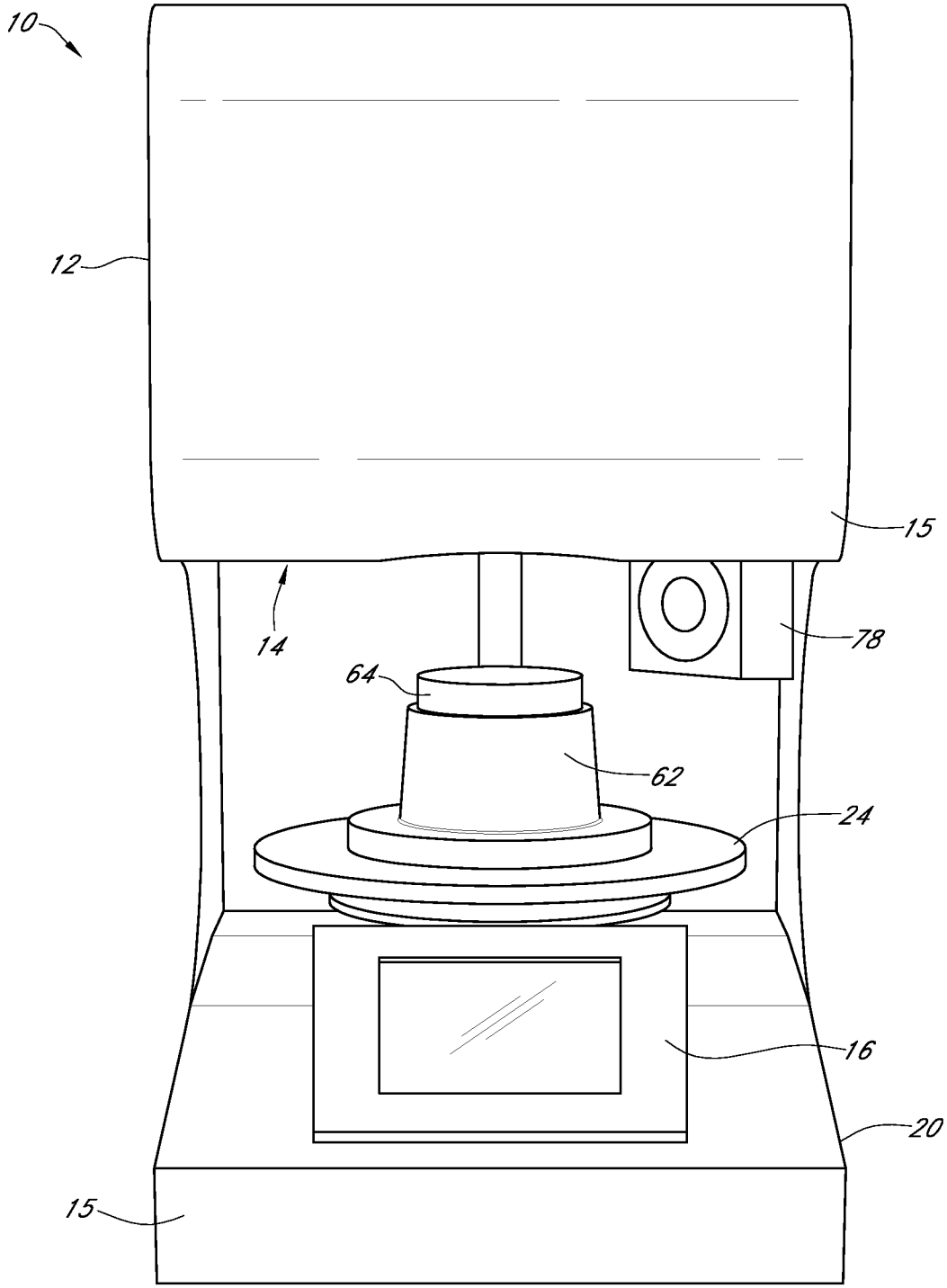
FIG. 1 is a front perspective view of one embodiment of a vacuum oven heat for treating a work piece and having a heat distribution apparatus constructed according to the teachings presented herein.
Figure 2:
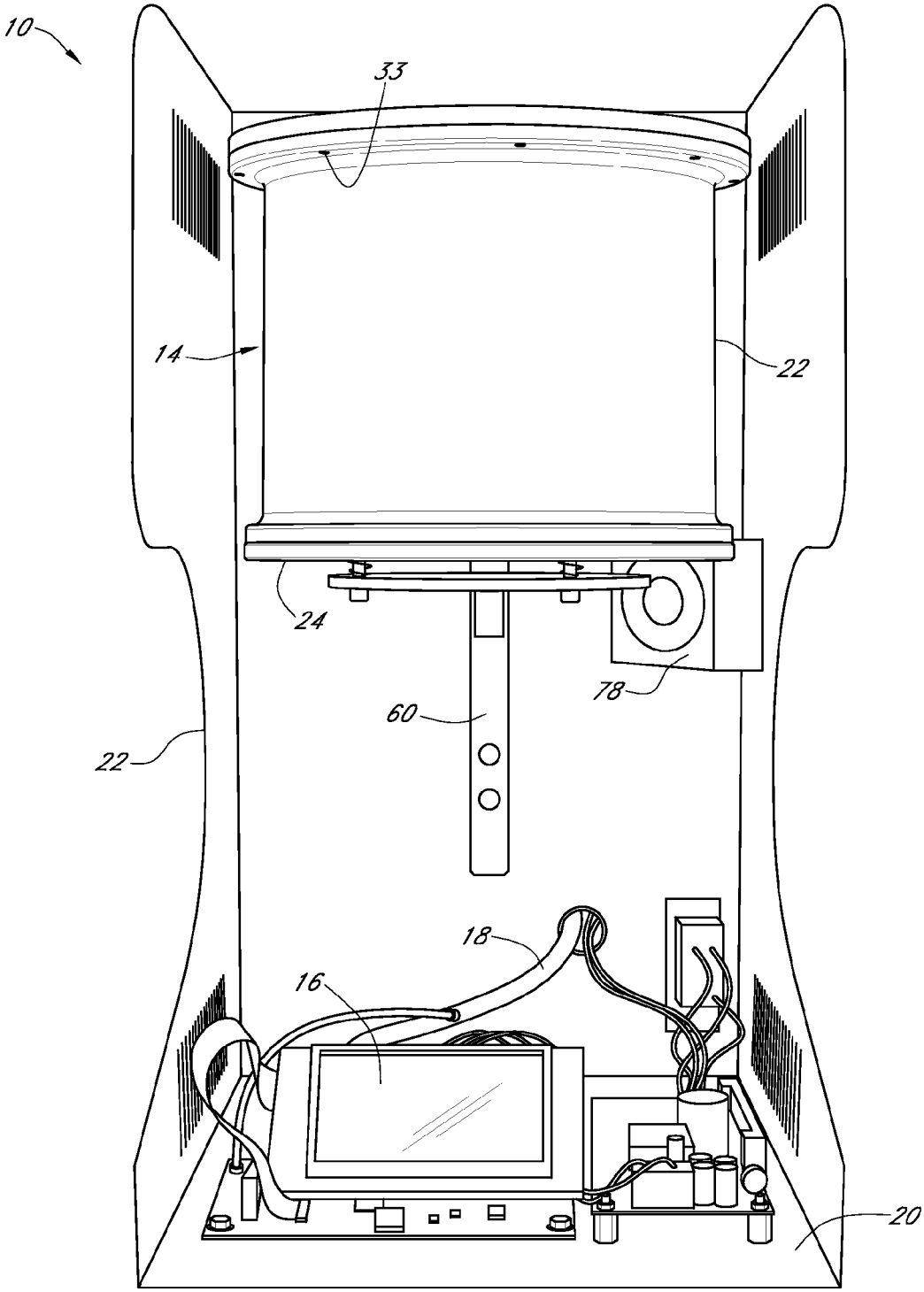
FIG. 2 is a front perspective view, with a partial cutaway, of the vacuum oven illustrated in FIG. 1 depicted in a closed or operational position for loading and unloading a work piece.
Figure 3:
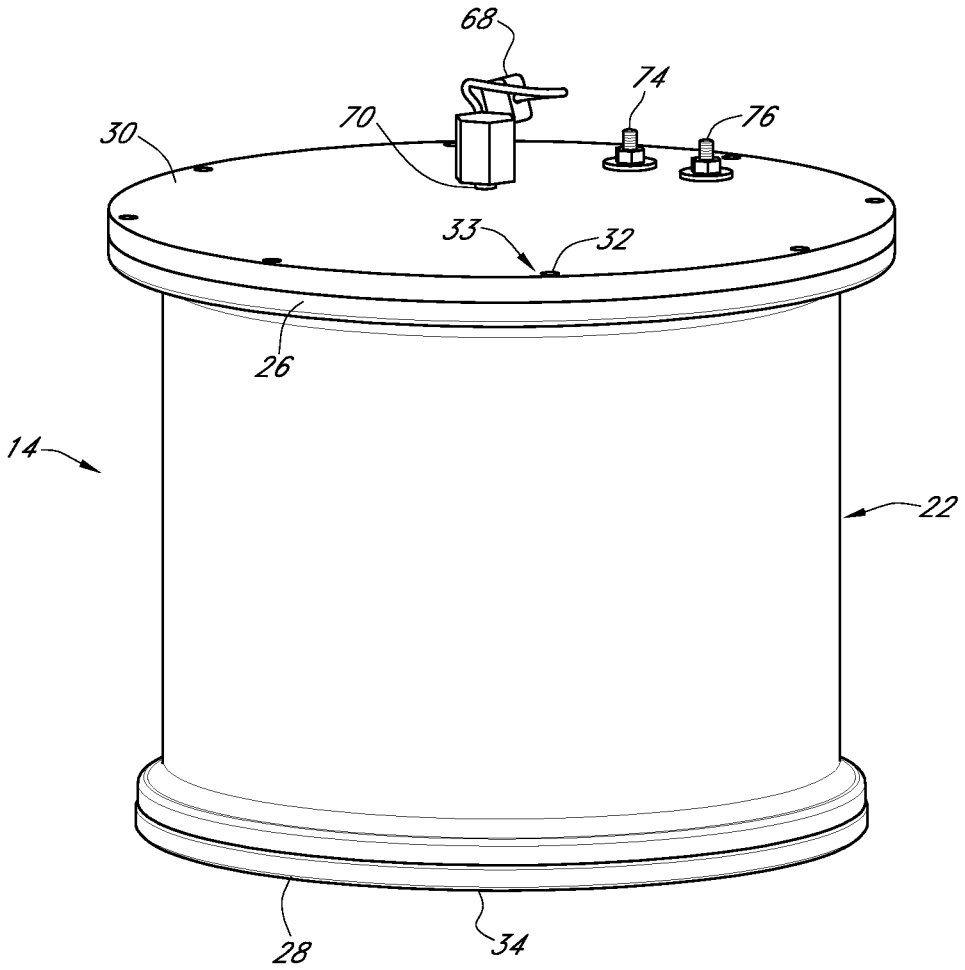
FIG. 3 is a front perspective view of one embodiment of a vacuum chamber assembly of the vacuum oven illustrated in FIG. 1.
Figure 4:
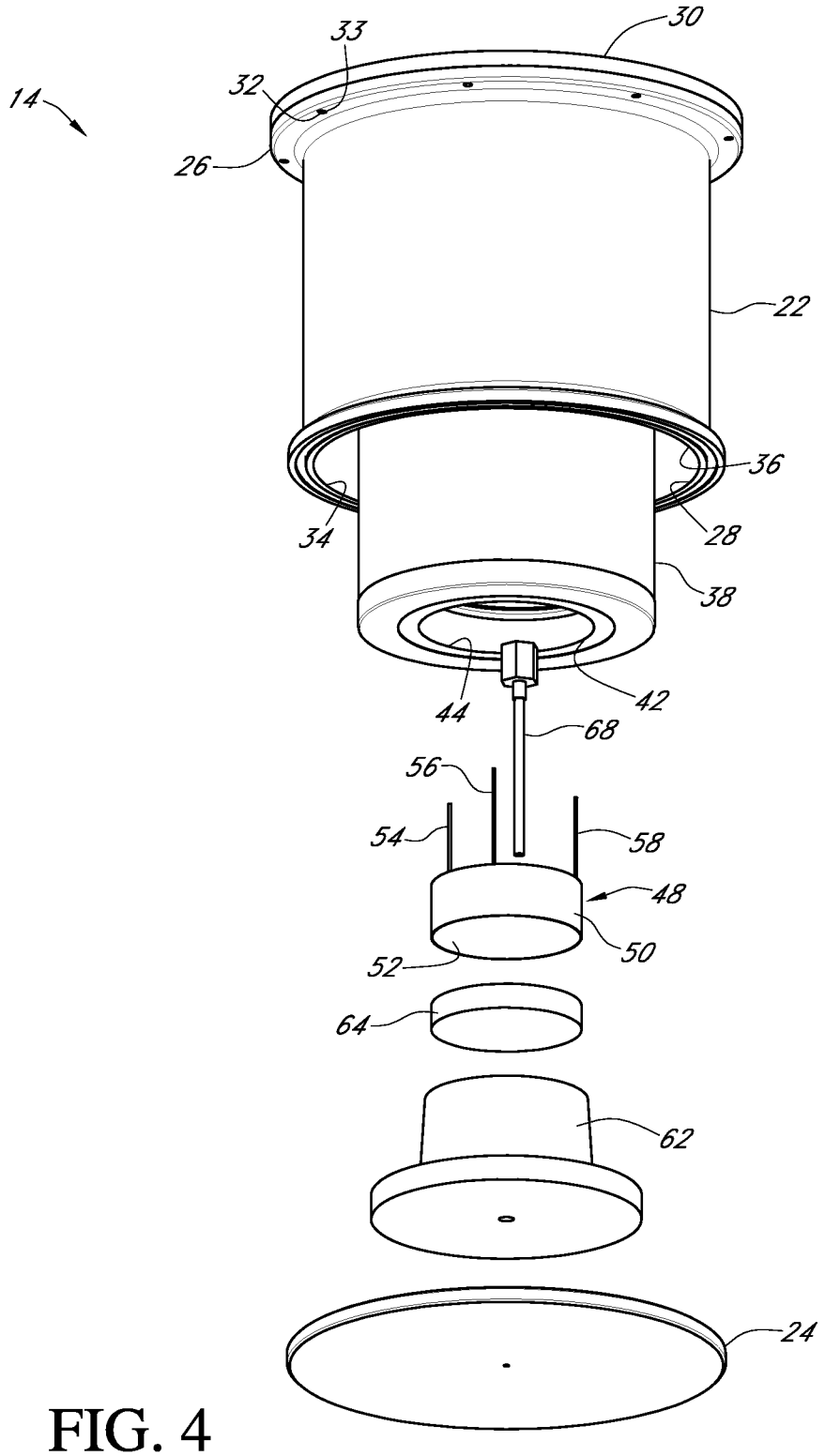
FIG. 4 is an exploded front perspective view of the vacuum chamber assembly illustrated in FIG. 3.
Figure 5:
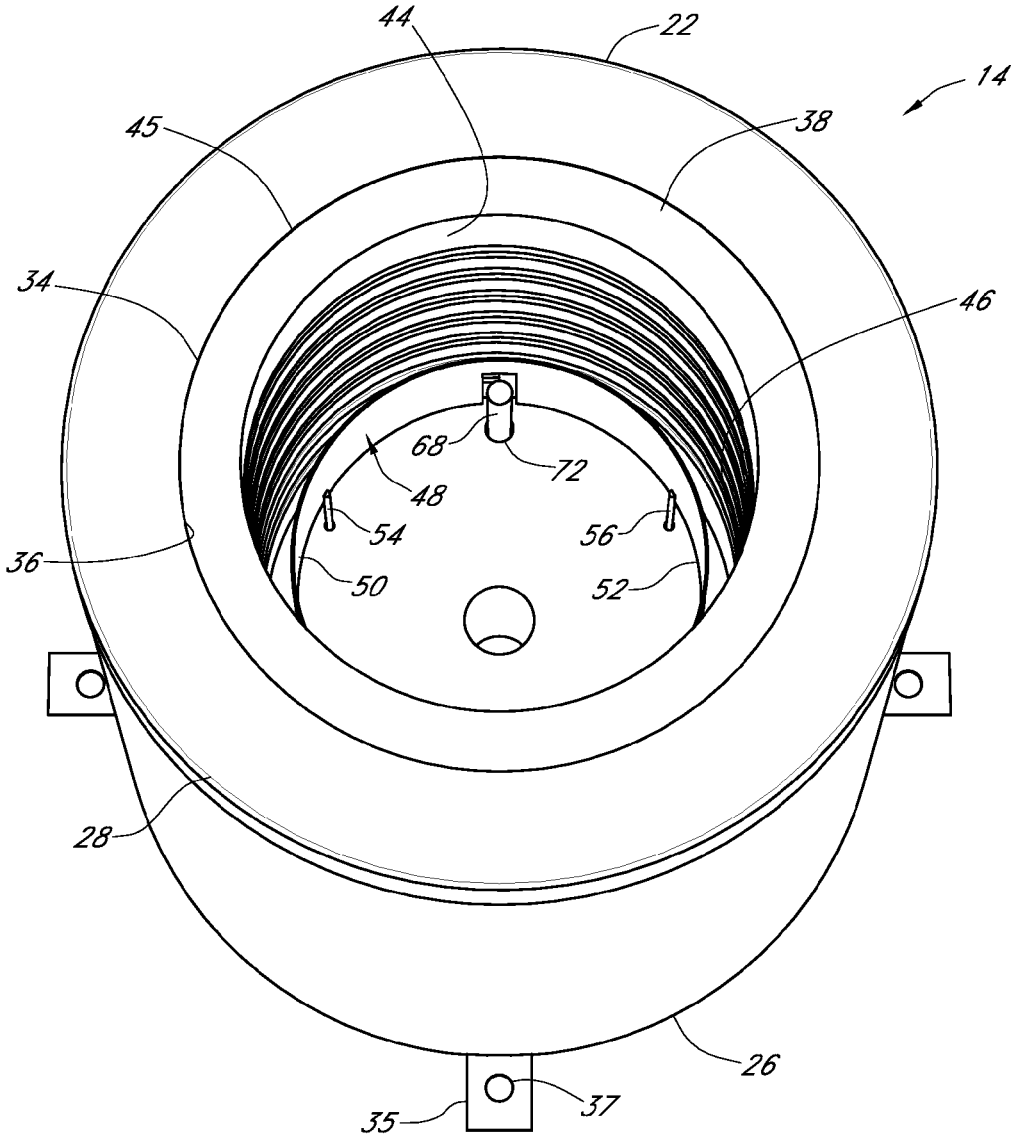
FIG. 5 is a bottom plan view of the vacuum chamber assembly illustrated in FIG. 3.
Figure 6:
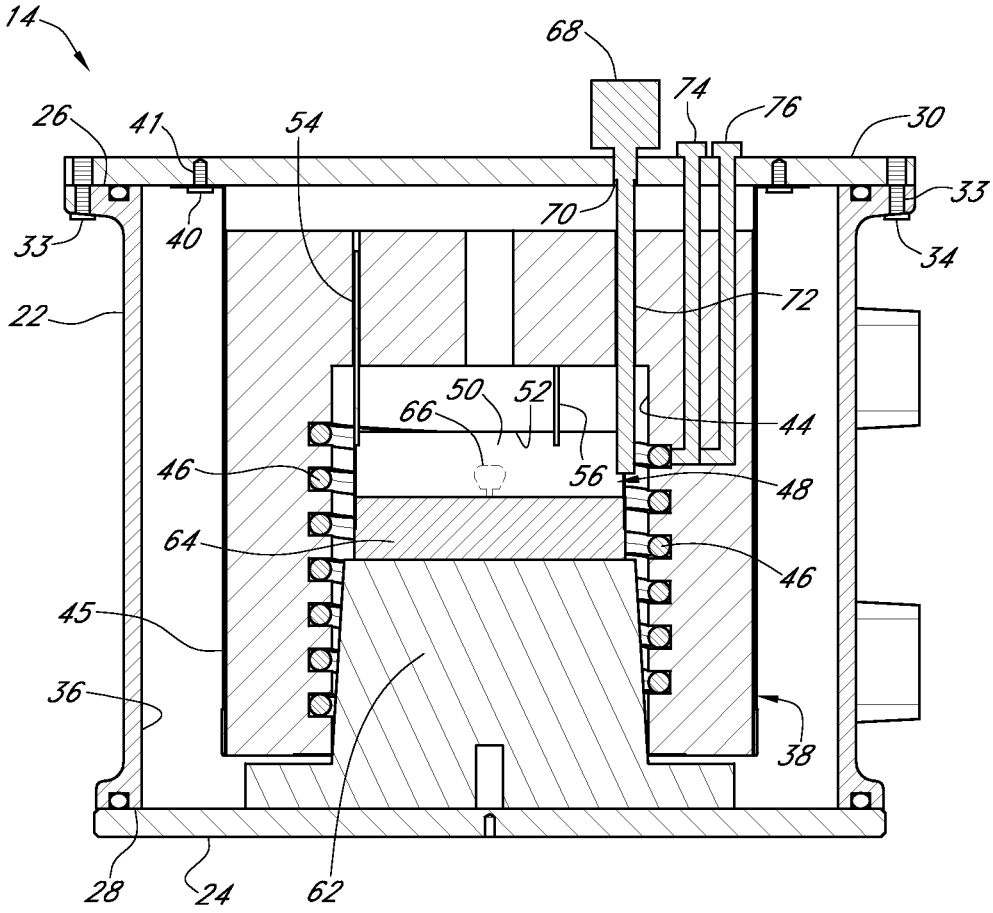
FIG. 6 is a cross-sectional front plan view of the vacuum chamber assembly illustrated in FIG. 3.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring to FIGS. 1-6, therein is depicted a vacuum oven that is schematically illustrated and generally designated 10. A body 12, which includes panels 15 (cutaway or removed in FIG. 2), supports a vacuum chamber assembly 14, which is depicted as a two-part, bottom loading vacuum chamber assembly. A control panel 16 with display and various supporting electronics 18 are mounted to a base 20 of the body 12 and, by way of internal communication through the body 12, located in electronic communication with the vacuum chamber assembly 14. The vacuum chamber assembly 14 is secured to the vacuum oven 10 and includes a vacuum chamber subassembly 22, and a lower chamber cover 24, among other components.

The vacuum chamber subassembly 22 includes ends 26, 28. As shown, the vacuum chamber subassembly 22 is coupled or suspended from the body 12, by taps 35 having openings 37 therein. A top chamber cover 30 is fastened to the end 26 and secured to the body 12 by fasteners, such as fastener 32, that are secured by mounting bores, such as bores 33. The vacuum chamber subassembly 22 is generally cylindrical with an opening 34 formed at the end 28 to provide access to an interior vacuum chamber 36. A muffle 38 is fastened to the top chamber cover 30, by fasteners and mounting bores, such as fastener 40 and bore 41, and suspended therefrom within the interior vacuum chamber 36. The muffle 38 may be generally cylindrical and may include an opening 42 providing access to an interior heating chamber 44. An annulus 44 is formed within the interior vacuum chamber 36 between the muffle 38 and the vacuum chamber subassembly 22 or there may be a friction fit between the muffle 38 and the vacuum chamber subassembly 22. It should be appreciated that the shape of the vacuum chamber subassembly 22 and the muffle 38 may vary with application and furnace.

Heating element 46 is under regulatable power and located within the muffle 38 proximate to the interior heating chamber 44. The heating element 46 may be a wire wound element or helical wound wire, for example. In one implementation, the heating element 46 includes a conic helix defined by a spiral traversing the muffle such that the pitch of the conic helix spans the interior heating chamber 44. In one embodiment, the heating element 46 is configured to provide radiant heat in a range from about 700° C. (1292° F.) to about 1200° C. (2192° F.). Radiant heat is provided as the operation of the vacuum minimizes or eliminates convection heat. It should be appreciated that multiple heating elements or heating element arrangements may also be used and are within the teachings presented herein to provide one resistive circuit/loop or multiple resistive circuits/loops.

A heat distribution sleeve 48 conforms to the shape of the interior heating chamber 44. As depicted, the heat distribution sleeve 48 is located in a substantially regularly spaced and offset relationship from the heating element 46. A thermal conductive material 50 of the heat distribution sleeve 48 absorbs and re-radiates heat emitted from the heating element 46. A furnace chamber 52 is formed within the heat distribution sleeve 48. In one implementation, hanging rods 54, 56, 58 suspend the heat distribution sleeve 48 from the vacuum chamber subassembly 22 through the muffle 38. It should be appreciated, however, that any type of offset or suspension technique may be utilized. As a result of the performance requirements of the heating element 44, the heat distribution sleeve 48 is configured to absorb and re-radiate heat in the range from about 700° C. (1292° F.) to about 1200° C. (2192° F.).

As mentioned, the heat distribution sleeve 48 matches the shape of the interior heating chamber 44 and as such inner chambers are often circular, the heat distribution sleeve 48 may be an annular shape, a ring, or similar circular shape in many embodiments. It should be further appreciated that although a particular design and structure for the heat distribution sleeve 48 is presented, the shape, spacing, and off-set of the heat distribution sleeve 48 may vary and include other shapes, including faceted shapes, irregular angles, and varied spacing, for example. The heat distribution sleeve 48 may comprise a material of high thermal conductivity, such as a metal, ceramic, or other material that will not melt or distort when repeatedly fired under the furnace conditions of the vacuum oven.

It should be understood that other mounting and installation techniques for the heat distribution sleeve 48, including side mounting and mounting from beneath the heat distribution sleeve 48, are within the teachings presented herein. In one embodiment, the heat distribution sleeve 48 has a length and dimensions that cover the heating element 46 having exposure to the interior heating chamber 44. It should be understood, however, that the dimensions including the thickness may vary so as to appropriately compliment the timing cycle of the vacuum oven. As depicted, the heat distribution sleeve 44 is of a cylindrical shape or normalizing ring having no top or bottom. In another embodiment, the heat distribution sleeve 44 conforms more completely or totally to the shape of the cavity defined by the interior heating chamber 44. In this embodiment, the heat distribution sleeve 48 has a form approximating a five or six sided chamber or its cylindrical equivalent.

In one embodiment, the lower chamber cover 24 is moveably secured to the body 12 and actuatable between an open or loading position (FIG. 1) where the lower chamber cover is located in a spaced relationship below the vacuum chamber subassembly 22 and a closed or operational position (FIG. 2) where the lower chamber cover 24 engages the vacuum chamber subassembly 22 at the opening 34. As shown, a vertical track 60 is mounted to body 12 behind the vacuum oven assembly 14. An arm is slidably secured to the vertical track 60 in order to support the lower chamber cover 24 and provide mobility, as described, thereto.

It should be appreciated that alternative embodiments to the bottom loaded vacuum oven described in the previous paragraph are applicable, wherein, upon the lower chamber cover and vacuum chamber subassembly being in the closed position, the work piece is located within the furnace chamber. That is, the lower chamber cover may be stationary and the vacuum chamber is moveably coupled to the body or, as previously discussed, the lower chamber cover is moveably coupled to the body and the vacuum chamber subassembly is stationary. Moreover, the heat distribution sleeve 66 may be utilized with a front loading vacuum oven.

A firebrick base 62 is mounted to the lower chamber cover 24 to support a work holding tray 64 configured to hold one or more work pieces 66. The work holding tray 64 provides a work area that is located within the furnace chamber and superposed or above the firebrick base for providing a raised or elevated space above the firebrick base 62 onto which the work piece or pieces 66 may be accepted, positioned, or set, for example. The work area may use pins, pegs, and variety of surfaces, for example, to provide for the securing of the work piece 66. It should be appreciated that a variety of techniques may be utilized to secure the work piece 66 and a work holding tray is but one embodiment. The portion of the furnace chamber 52 that exceeds the placement of the firebrick base 62 defines an inner zone of maximal temperature within the furnace chamber 52. In operation, upon the lower chamber cover 24 being in the closed position, the work holding tray 64 is located proximate to or within the furnace chamber 52, in this location.

A thermocouple 68 extends through the vacuum chamber subassembly 22 and the muffle 38 by way of mounting holes 70, to accurately measure the temperature in the furnace chamber 52 proximate to the work holding tray and work pieces. The mounting holes 70, 72 for the thermocouple 68 may provide for a threadable engagement. Power conduits 74, 76 are configured to provide electrical communication between the heating element 46 and a power source. A fan 78 is secured to the body 12 and oriented to circulate air over the opening 34 of the vacuum chamber subassembly 22. As previously alluded, the teachings disclosed herein while relating to vacuum furnaces are particularly applicable to dental vacuum ovens and furnaces of the type used in the dental industry for firing crowns, implants and any type of porcelain fixture.

Figure 7:
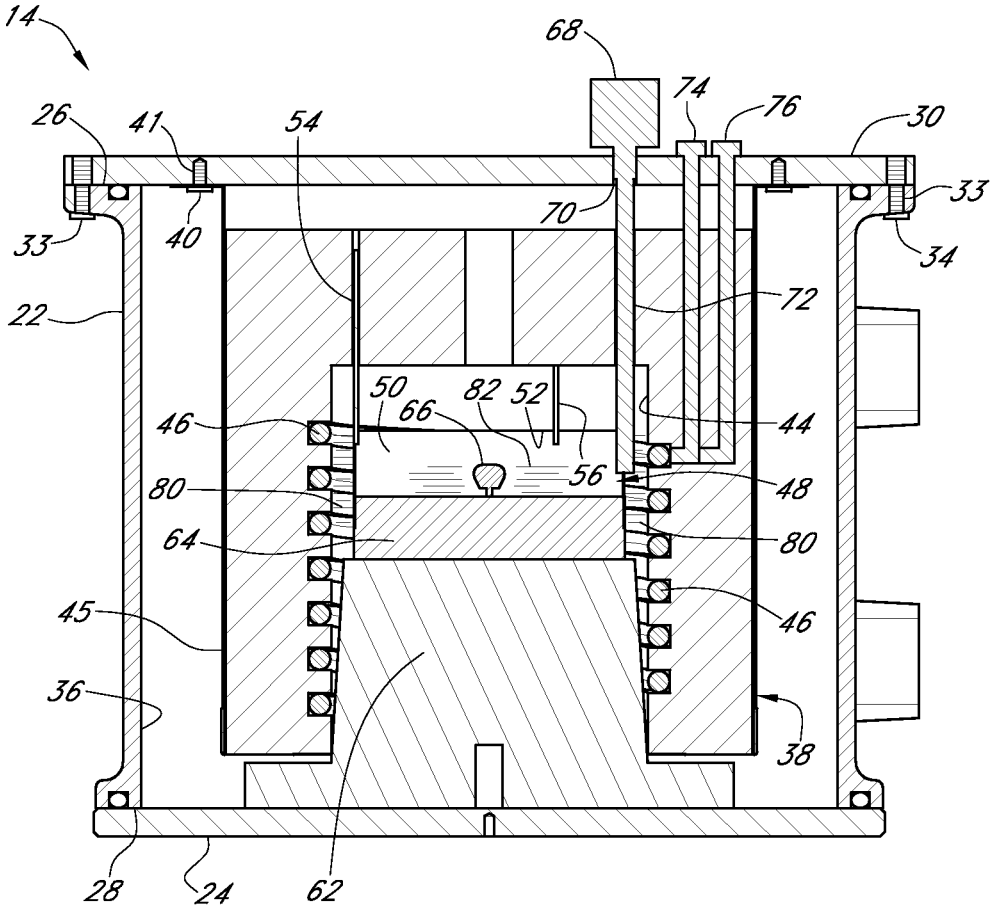
FIG. 7 is also a cross-sectional front plan view of the vacuum chamber assembly illustrated in FIG. 3, wherein a work piece is being fired.

Referring to FIG. 7, the working area provided by the work holding tray 64 may be loaded with work pieces or parts 66 that may be made of many materials including steel, ceramics, porcelain, clays, composites, or other materials. The characteristics of the work piece are important to the vacuum oven 10 operation. In particular, the heating cycle of the vacuum oven 10 is proportional to the thickness of the work piece 66, as well as the material of the work piece 66. As illustrated, a porcelain work piece 66 is positioned on the work holding tray 64 for heat treatment. In operation, the vacuum oven 10 is held at a vacuum, with the parts being fired determining the required quality of the vacuum. As previously discussed, the heat distribution sleeve 48 includes a thermal conductive material 50 which absorbs heat 80 emitted from the heating element 46 and re-radiates the heat 82 emitted from the heating element 46 as heat.

In particular, the heat distribution sleeve 48 absorbs the heat, becomes hot and then re-radiates the heat. The heat distribution sleeve 48 therefore functions like a normalizing device or heat capacitance device, which mitigates unwanted variations in the radiant heat provided by the heating element 46. Due to the vacuum inside, the main heat transfer that occurs is a result of radiation from the coils or panels functioning as the heating element 46. As radiant heat transfer is a line of sight type transfer, any difference in exposure can cause different temperatures on the parts within the working area. The heat distribution sleeve 48 is positioned between or interposed between the interior heating chamber 44 having the heating element 46 therein and the work pieces 66 to reduce temperature variation and create a more balanced distribution of radiation. The heat distribution sleeve 48 lowers the temperature variations within the work area compared to vacuum ovens or furnaces without the device.

As previously alluded, the inconsistent and irregular radiation fields may cause problems when heat treating a work piece. This is especially true with substances having low heat transfer coefficients. In this respect, the heat distribution sleeve 48 provides a device which may be inserted, e.g., an after-market solution, or built into the furnace to reduce spatial temperature variations within the work area.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A vacuum oven comprising:

a body;

a vacuum chamber subassembly having a first end and a second end, the vacuum chamber subassembly including a top chamber cover fastened to the first end, the vacuum chamber subassembly being coupled to the body, the vacuum chamber subassembly being generally cylindrical having an opening formed at the second end providing access to an interior vacuum chamber;

a muffle fastened to the top chamber cover and suspended therefrom within the interior vacuum chamber, the muffle being generally cylindrical having an opening providing access to an interior heating chamber;

a heating element under regulatable power located within the muffle proximate to the interior heating chamber;

a heat distribution sleeve conformed to the shape of the interior heating chamber, the heat distribution sleeve located in a substantially regularly spaced relationship from the heating element, the heat distribution sleeve including a thermal conductive material which absorbs and re-radiates heat emitted from the heating element;

a furnace chamber formed within the heat distribution sleeve;

a plurality of hanging rods suspending the heat distribution sleeve from the muffle;

a lower chamber cover moveably secured to the body, the lower chamber cover actuatable between an open position where the lower chamber cover is located in a spaced relationship below the vacuum chamber subassembly and a closed position where the lower chamber cover engages the vacuum chamber subassembly at the opening; and a firebrick base mounted to the lower chamber cover, the firebrick base supporting a work piece; and wherein, upon the lower chamber cover being in the closed position, the work piece is located within the furnace chamber.

2. The vacuum oven as recited in claim 1, further comprising:

a vertical track mounted to the body;

an arm slidably secured to the vertical track, wherein the arm supports the lower chamber cover.

3. The vacuum oven as recited in claim 1, wherein the body further comprises a control panel and supporting electronics mounted to a base.

4. The vacuum oven as recited in claim 1, further comprising a fan secured to the body and oriented to circulate air over the opening of the vacuum chamber subassembly.

5. The vacuum oven as recited in claim 1, further comprising a thermocouple threadably engaged through the vacuum chamber subassembly and muffle, the thermocouple configured to measure the temperature proximate the furnace chamber.

6. The vacuum oven as recited in claim 1, further comprising power conduits traversing the vacuum chamber subassembly and muffle, the power conduits configured to provide electrical communication between the heating element and a power source.

7. The vacuum oven as recited in claim 1, wherein the heating element further comprises a wire wound element.

8. The vacuum oven as recited in claim 1, wherein the heating element provides radiant heat in the range from about 700° C. to about 1200° C.

9. The vacuum oven as recited in claim 1, wherein the heat distribution sleeve is configured to absorb and re-radiate heat in the range from about 700° C. to about 1200° C.

10. The vacuum oven as recited in claim 1, wherein the work piece is selected from the group consisting of steel, ceramics, porcelain, clays, and composites.

11. The vacuum oven as recited in claim 1, further comprising a securing device for holding the work piece in place, the securing device being selected from the group consisting of pins and a work holding tray.

12. A vacuum oven comprising:

a body;

a vacuum chamber subassembly having a first end and a second end, the vacuum chamber subassembly including a top chamber cover fastened to the first end, the vacuum chamber subassembly being coupled to the body, the vacuum chamber subassembly being generally cylindrical having an opening formed at the second end providing access to an interior vacuum chamber;

a muffle fastened to the top chamber cover and suspended therefrom within the interior vacuum chamber, the muffle being generally cylindrical having an opening providing access to an interior heating chamber;

a heating element under regulatable power located within the muffle proximate to the interior heating chamber;

a heat distribution sleeve conformed to the shape of the interior heating chamber, the heat distribution sleeve located in a substantially regularly spaced relationship from the heating element, the heat distribution sleeve including a thermal conductive material which absorbs and re-radiates heat emitted from the heating element;

a furnace chamber formed within the heat distribution sleeve;

a plurality of hanging rods suspending the heat distribution sleeve from the muffle;

a lower chamber cover secured to the body, the lower chamber cover and vacuum chamber subassembly having an open position where the lower chamber cover is located in a spaced relationship below the vacuum chamber subassembly and a closed position where the lower chamber cover and the vacuum chamber subassembly are engaged at the opening; and a firebrick base mounted to the lower chamber cover, the firebrick base supporting a work piece, wherein, upon the lower chamber cover and vacuum chamber subassembly being in the closed position, the work piece is located within the furnace chamber.

13. The vacuum oven as recited in claim 12, wherein the lower chamber cover is stationary and the vacuum chamber is moveably coupled to the body.

14. The vacuum oven as recited in claim 12, wherein the lower chamber cover is moveably coupled to the body and the vacuum chamber subassembly is stationary.

* * * * *